US009885520B1

(12) United States Patent
Abbasi

(10) Patent No.: US 9,885,520 B1
(45) Date of Patent: Feb. 6, 2018

(54) GRAIN CONDITIONING SYSTEM AND METHODOLOGY

(71) Applicant: Shafagh Abbasi, Winnipeg (CA)

(72) Inventor: Shafagh Abbasi, Winnipeg (CA)

( * ) Notice: Subject to any disclaimer, the term of this patent is extended or adjusted under 35 U.S.C. 154(b) by 0 days.

(21) Appl. No.: 15/227,020

(22) Filed: Aug. 3, 2016

(51) Int. Cl.

| | |
|---|---|
| ***F26B 21/12*** | (2006.01) |
| ***F26B 3/04*** | (2006.01) |
| ***F26B 21/00*** | (2006.01) |
| ***F26B 21/08*** | (2006.01) |
| ***F26B 21/10*** | (2006.01) |

(52) U.S. Cl.
CPC ..... *F26B 21/12* (2013.01); *F26B 3/04* (2013.01); *F26B 21/001* (2013.01); *F26B 21/08* (2013.01); *F26B 21/10* (2013.01); *F26B 2200/06* (2013.01)

(58) Field of Classification Search
CPC ..... F26B 21/12; F26B 3/04; F26B 21/001; F26B 21/10; F26B 2200/16
USPC ..... 34/391, 90, 167
See application file for complete search history.

(56) References Cited

U.S. PATENT DOCUMENTS

| | | | | | |
|---|---|---|---|---|---|
| 3,264,118 | A | | 8/1966 | Kilcrease | |
| 3,943,636 | A | | 3/1976 | Sietmann | |
| 4,043,051 | A | * | 8/1977 | Lussenden | F26B 9/082 34/229 |
| 4,152,840 | A | * | 5/1979 | Stille | F26B 9/063 34/575 |
| 4,583,300 | A | | 4/1986 | Mast | |
| 4,916,830 | A | | 4/1990 | Braun | |
| 5,144,755 | A | | 9/1992 | Braun | |
| 5,566,471 | A | * | 10/1996 | Hirano | D06F 57/00 160/5 |
| 5,570,521 | A | * | 11/1996 | Baker | F26B 17/122 34/550 |
| 6,199,388 | B1 | | 3/2001 | Fischer | |
| 6,530,160 | B1 | | 3/2003 | Gookins | |
| 6,751,964 | B2 | | 6/2004 | Fischer | |
| 6,834,443 | B2 | * | 12/2004 | Bloemendaal | F26B 17/126 34/165 |
| 8,479,408 | B2 | | 7/2013 | Salisbury | |
| 8,726,539 | B2 | * | 5/2014 | Potter | F26B 9/02 165/54 |
| 8,806,772 | B1 | | 8/2014 | Schaefer, Jr. | |
| 9,470,455 | B2 | * | 10/2016 | Stanish | F26B 25/22 |

(Continued)

FOREIGN PATENT DOCUMENTS

| | | | | |
|---|---|---|---|---|
| CA | 2899739 A1 | * | 2/2016 | F26B 25/22 |
| JP | 03134483 A | * | 6/1991 | |

*Primary Examiner* — Stephen M Gravini
(74) *Attorney, Agent, or Firm* — Potomac Law Group, PLLC; Charles B. Lobsenz; Brian H. Buck

(57) ABSTRACT

A system and methodology associated with a connected farming system which includes an intake air modification unit which includes at least one fan, a dehumidifier and a cooling component and which collectively function to condition intake air so as to dry and cool the air prior to introduction into a grain bin. One or more sensors are provided which serve to control the operation of the intake air modification unit such that the air modification unit operates efficiently and taking into account external factors such as the presence/level of grain in the bin, the ambient weather conditions including relative humidity levels and ambient air temperature as well as qualitative characteristics of the air exiting the grain bin to include relative humidity and air temperature.

20 Claims, 5 Drawing Sheets

(56) References Cited

U.S. PATENT DOCUMENTS

2016/0040933 A1* 2/2016 Stanish ..... F26B 25/22
34/427

* cited by examiner

GRAIN CONDITIONING SYSTEM AND METHODOLOGY

RELATED APPLICATION AND SUBJECT MATTER

This application is related in subject matter to application Ser. No. 15/164,931 filed May 26, 2016, entitled "Connected Farming System with Grain Bin Condition Reporting and Control," currently pending and assigned to the same assignee as the assignee of the present application. The subject matter of the foregoing application is expressly incorporated herein.

FIELD OF THE DISCLOSURE

Embodiments of the present invention relate generally to systems and methods for crop conditioning and more particularly to systems and methods for efficiently cooling and drying grain and other crops in a wide variety of weather conditions.

BACKGROUND

Grain crops are required to be relatively dry and relatively cool in order to be usable. When grain is not sufficiently dry or cool, various issues arise which may make the crop less desirable and, in some cases, unsalable. For example, with sufficiently high levels of moisture content or sufficiently high temperatures, infestation by insects and/or microorganisms may occur. In addition, seed germination may result within the crop or the crop may otherwise be unacceptable for sale to consumers as a result of degraded appearance and/or taste.

In order to successfully harvest grain crops, it is necessary that the grain be both suitably cool and suitably dry. Some traditional approaches for producing usable grain is to harvest grain only during dry periods and/or using the sun to dry the grain and/or using in-line aeration fans to cool the grain. As may be expected, in many regions, the relative humidity of the air is typically high enough that these techniques are not reasonably available or they are only available during very short time windows during the year. This is due to the fact that in order to cool the grain using, for example, an aeration fan, the outside air temperature must be lower than the current temperature of the grain. Similarly, in order to dry the grain, the ambient relative humidity as well as the outside air temperature must be lower than that of the grain.

The foregoing weather conditions exist only on a very limited basis, particularly in hotter/more humid regions, thus severely limiting the ability to use the aforementioned techniques for drying and/or cooling grain. Even if suitable conditions exist, the timing of the crop maturity and required delivery time frames may not coincide with suitable weather conditions where the outside air is sufficiently cool and dry.

Additional drawbacks are associated with the use of aeration fans for cooling in that they can be expensive and use significant amounts of energy at a high cost. Because these fans are expensive and use a lot of power, many farms tend to have a number of fans which is significantly less than the number of grain bins. As such, it is necessary to move the fans to where the grain is or, alternatively, move grain around to the location of the fans. Even more problematic is the fact that these fans actually damage the grain in higher relative humidity conditions, if operated during those conditions, because they are introducing additional moisture to the grain notwithstanding that they may be cooling the grain to some degree.

In terms of grain drying, relying on the sun to dry the grain is not ideal for many reasons. For one, it requires the grain to be taken out of the grain bin so that the sun may directly act on the grain and moisture is allowed to escape. Perhaps more importantly, sun drying is generally not effective due to the unreliability of weather conditions and the potential for rain, clouds and other conditions which prevent drying or even introduces more moisture than was originally present.

Another known technique for grain drying is the use of in-line dryers. These dryers are used to blow warm air over the grain with the intention of drying the grain through the application of heat. In some cases, these dryers are employed on the farm with the warm air being introduced directly into the grain bin used for storing the crop. In other cases, grain may be moved to specialized facilities specifically for grain drying using these dryers.

There exist a number of drawbacks with the foregoing grain drying systems which blow warm air over the grain. For one, these dryers use significant amounts of energy and they can act in effect like an oven, resulting in over-drying and/or cracking of the grain. Perhaps more critically, these dryers are ineffective in conditions of high relative humidity in that the air introduced may be warm but it is also moist which often results in an increase in grain moisture content as opposed to the desired decrease. For example, if it is raining, it is not possible to run the drying fans as their use would cause the introduction of a significant amount of moisture into the grain under these conditions. As a result, the dryers are typically only used during periods of relatively low humidity which can be severely limiting depending on the region and the specific harvest schedule for the crops.

While farmers have available to them various existing techniques for drying and cooling grain, none of the current systems and/or methodologies are ideal. Some are limited in terms of when they are available for use, others are inefficient in their use of power, yet others actually harm the crops when used when they shouldn't be and still others require the movement of the grain from bin to bin or even to a remote location.

SUMMARY

It is to be understood that both the following summary and the detailed description are exemplary and explanatory and are intended to provide further explanation of the present invention as claimed. Neither the summary nor the description that follows is intended to define or limit the scope of the present invention to the particular features mentioned in the summary or in the description. Rather, the scope of the present invention is defined by the appended claims.

In certain embodiments, the disclosed embodiments may include one or more of the features described herein.

An aspect of the present invention provides a method of operating a grain treatment system which serves to condition grain and other crops such that the grain and crops are saleable and do not suffer from problematic conditions resulting from being too moist or too hot.

Another aspect of the current invention provides a system incorporating various components which operate to cool and dry grain and other crops in a wide variety of ambient weather conditions including those where air temperature is relatively hot and/or where the ambient relative humidity is relatively high.

A still further aspect of the present invention provides such a system which includes an intake air modification unit which acts to condition intake air prior to introducing the air into a grain bin such that the conditioned air serves to cool and dry the grain contained within the bin in a variety of weather conditions.

Another aspect of the present invention provides a system which includes an intake air modification unit which includes at least one fan, a dehumidifier and a cooling component which collectively function to condition intake air so as to dry and cool the air prior to introduction into a grain bin.

A yet further aspect of the present invention provides one or more sensors which serve to control the operation of the intake air modification unit such that the air modification unit operates efficiently and takes into account external factors such as the presence/level of grain in the bin as well as ambient weather conditions such as relative humidity levels and ambient air temperature.

Another aspect of the present invention provides such sensors at the air intake of the intake air modification unit and/or at the air outflow location(s) from the grain bin such that the qualitative aspects of input air and outflow air may be monitored to control the operation of the intake air modification unit.

A further aspect of the invention provides a system incorporating multiple grain bins and the related and aforementioned intake air modification units and sensors, at least one reader device, at least one gateway device and at least one user device wherein the sensors communicate qualitative air parameter values to a reader device which in turn wirelessly communicates these parameter values to a gateway device, and wherein the qualitative air parameter values are made available to users via the user devices based upon a network connection between the gateway device and the user device and/or the cloud and a user device.

A still further aspect of the invention provides a system in which users can monitor and control the operation of the intake air modification units via a network connection between a user device such as a smartphone and a gateway which, in turn, communicates with one or more air modification units.

An even further aspect of the invention provides a system in which users can monitor and control the operation of the intake air modification units via a direct network connection between a user device such as a smartphone and one or more air modification units.

These and further and other objects and features of the present invention are apparent in the disclosure, which includes the above and ongoing written specification, with the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. Embodiments of the present invention will be more particularly described in conjunction with the following drawings wherein.

DETAILED DESCRIPTION

Figure 1:
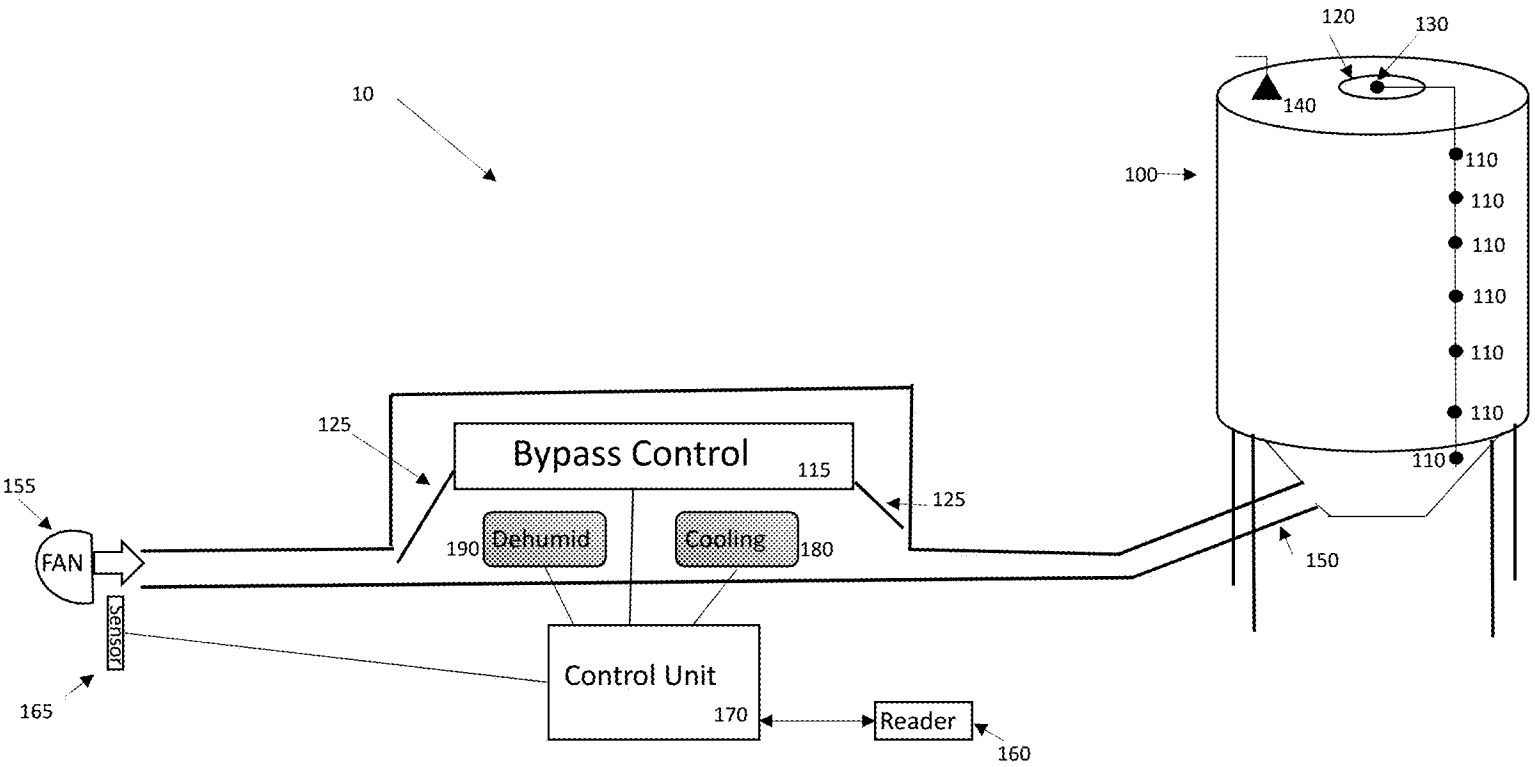
FIG. 1 is a block diagram of a grain conditioning system, according to an embodiment of the present invention.

Embodiments of grain conditioning system and methodology will now be disclosed in terms of various exemplary embodiments. This specification discloses one or more embodiments that incorporate features of the present invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. The skilled artisan will appreciate that a particular feature, structure, or characteristic described in connection with one embodiment is not necessarily limited to that embodiment but typically has relevance and applicability to one or more other embodiments.

In the several figures, like reference numerals may be used for like elements having like functions even in different drawings. The embodiments described, and their detailed construction and elements, are merely provided to assist in a comprehensive understanding of the present invention. Thus, it is apparent that the present invention can be carried out in a variety of ways, and does not require any of the specific features described herein. Also, well-known functions or constructions are not described in detail since they would obscure the present invention with unnecessary detail.

The description is not to be taken in a limiting sense, but is made merely for the purpose of illustrating the general principles of the present invention, since the scope of the present invention is best defined by the appended claims.

It should also be noted that in some alternative implementations, the blocks in a flowchart, the communications in a sequence-diagram, the states in a state-diagram, etc., may occur out of the orders illustrated in the figures. That is, the illustrated orders of the blocks/communications/states are not intended to be limiting. Rather, the illustrated blocks/communications/states may be reordered into any suitable order, and some of the blocks/communications/states could occur simultaneously.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an" and "the" are intended to include the plural forms as well, unless the context clearly indicates otherwise.

The word "exemplary" is used herein to mean "serving as an example, instance, or illustration." Any embodiment described herein as "exemplary" is not necessarily to be construed as preferred or advantageous over other embodiments. Additionally, all embodiments described herein should be considered exemplary unless otherwise stated.

The word "network" is used herein to mean one or more conventional or proprietary networks using an appropriate network data transmission protocol. Examples of such networks include, PSTN, LAN, WAN, WiFi, WiMax, Internet, 35 World Wide Web, Ethernet, other wireless networks, and the like.

The phrase "wireless device" is used herein to mean one or more conventional or proprietary devices using radio frequency transmission techniques. Examples of such wireless devices include cellular telephones, desktop computers, laptop computers, handheld computers, electronic games, portable digital assistants, MP3 players, DVD players, or the like.

With reference now to FIG. 1, the various components of the grain conditioning system of the present invention is now described. While the following description generally refers to the treatment (drying and cooling) of grain, the invention is not necessarily limited thereto and various other crops may be treated through the use of the grain conditioning system of the present invention without departing from the scope or spirit thereof.

In a preferred embodiment of the present invention, some or all of the following components comprise what will be referred to herein as intake air modification unit or "IAMU" 10—fan 155, air intake sensor 165, control unit 170, reader 160, dehumidifier 190, cooling unit 180, bypass control 115 and air flow controllers 125. Each of these components as well as other components which are included in the overall grain conditioning system of the present invention will be described in detail herein.

IAMU 10 interacts with and is connected via at least one air duct 150 with grain bin 100. Grain bin 100 is used to hold one or more crops including various grains and other farm products. The teachings of the present invention apply to grain bins of all sizes and shapes. That said, the cooling and drying capabilities of IAMU 10 are preferably scaled to the size and shaping of the attached grain bin(s) 100. For larger capacity grain bins, additional cooling, dehumidification and air movement capability within IAMU 10 should be provided by cooling unit 180, dehumidifier 190 and fan 155, respectively.

Grain bin 100 preferably includes at least one sensor cable with multiple sensor elements 110 contained thereon. The sensor cable(s) are deployed within the grain (or other product) contained in grain bin 100 and the sensors are preferably configured to assess temperature and/or moisture content within the grain at the location of the sensor. At the terminus of the sensor cable, exit sensor 130 capable of detecting exit air temperature and exit air humidity is preferably included. The location of exit sensor 130 is at one or more locations of grain bin 100 where air is free to exit grain bin 100 such as at opening 120.

Although FIG. 1 shows a single opening at the top of grain bin 100, in practice more than one opening may be provided and they may be at alternate locations on grain bin 100 such as near the bottom and/or on the sides. Preferably an exit sensor 130 is placed at each such opening within grain bin 100. Grain bin 100 may also have associated with it one or more readers 140 which are capable of wirelessly transmitting data from sensors 110 and exit sensor(s) 130 to a remote gateway and/or to one or more user devices.

With reference still to FIG. 1, each of the specific components of IAMU 10 is now described along with their specific role and interaction with the components present at or near grain bin 100 which have been previously described. In a general sense, air flows at the opening of duct 150 (towards the left side of FIG. 1) through IAMU 10 and into grain bin 100. Although FIG. 1 shows duct 150 entering grain bin 100 at the bottom, this invention is not necessarily limited thereto and duct 150 may enter grain bin 100 at various other locations. Additionally, although not shown, multiple ducts 150 may be provided and/or single ducts 150 may branch out into multiple ducts to create multiple entry points into grain bin 100.

In a preferred embodiment, all components associated with IAMU 10 are under the control of control unit 170. Control unit 170 may wirelessly connect with a remote gateway and/or user devices via reader 160 to permit monitoring, configuration and/or control of IAMU 10. In addition, control unit 170 and/or reader 160 may communicate with reader 140 located in the vicinity of grain bin 100 so as to receive data generated by one or more sensors in grain bin 100. In some embodiments, reader 140 and reader 160 may be the same unit.

IAMU 10 also preferably includes input sensor 165 which is capable of measuring and reporting the intake/ambient air temperature and relative humidity. This data is periodically provided to control unit 170 such that the operation of IAMU 10 generally can be controlled. For example, and as discussed in more detail below, when ambient temperature is low, cooling unit 180 may be run at lower power and similarly when ambient relative humidity is low, dehumidifier 190 may be run at lower power. As yet another example, sensor 165 may also be capable of detecting the existence of rain. In such cases and as correlated with a high humidity reading, it may be that it is inefficient or not even possible to run IAMU 10 effectively so each of dehumidifier 190 and cooling unit 180 may be completely shut down. Similarly, in the case of rain, fan 155 may be completely turned off or speed significantly reduced so as to limit the introduction of additional moisture into the grain.

Bypass control 115 includes and controls one or more air flow controllers 125 which control the flow of air. This permits the ability to either completely shut off or restrict, at different levels, the amount of airflow which passes by dehumidifier 190 and/or cooling unit 180. For example, in the case of a dry and cool ambient environment, control unit 170 may direct that fan 155 be turned on at a low level, that bypass control 115 permit only 30% of the airflow to pass over dehumidifier 190 and cooling unit 180, that dehumidifier 190 run at 20% of full available capacity and that cooling unit 180 run at 15% of full available capacity.

The foregoing is merely one example of possible control settings as dictated by control unit 170. Control unit 170 may dictate settings based on pre-configured algorithms taking into account various factors such as ambient temperature and ambient relative humidity (as measured by input sensor 165), grain level in grain bin (as calculated using data from sensors 110 or another means), and/or exit air temperature and exit air humidity (as measured by exit sensor 130). Alternatively, or in addition, control unit may adjust settings based on specific user input provided by user devices and/or a central control algorithm which spans multiple grain bins 100 and which such algorithm may be implemented by software or firmware resident on, for example, a remote gateway.

In a preferred embodiment of the present invention, the collective functionality of control unit 170 and reader 160 preferably includes a processor, local storage, RF capability enabling wireless communication to a gateway and/or directly with one or more user devices which may be used to monitor, configure and/or control intake air modification unit (IAMU) 10. Some or all of this functionality may be supplemented and/or replaced by functionality located on a central gateway or based in the cloud.

Figure 2:
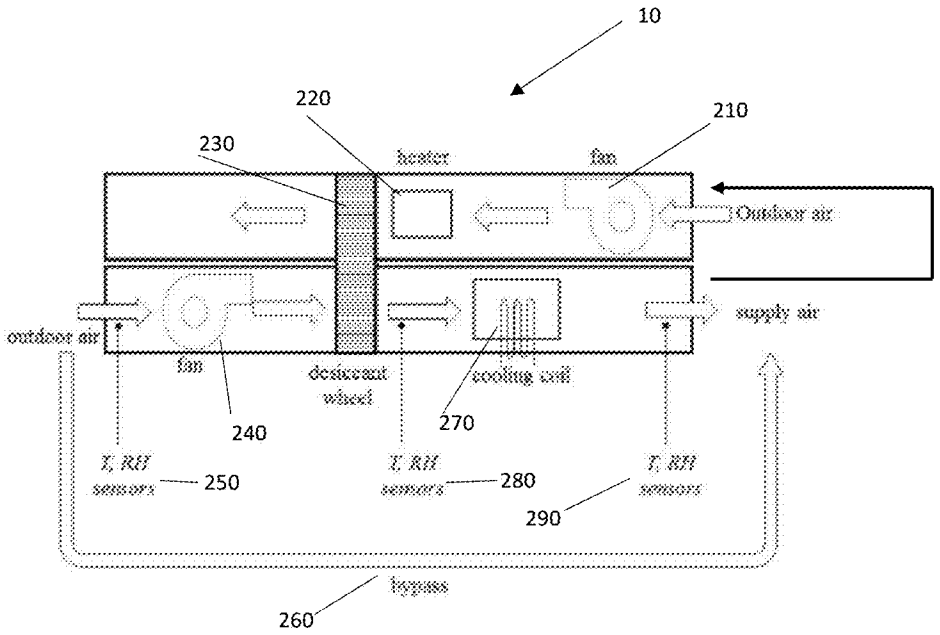
FIG. 2 is a block diagram of the primary components of the intake air modification unit of the present invention, according to one embodiment thereof.
Figure 3:
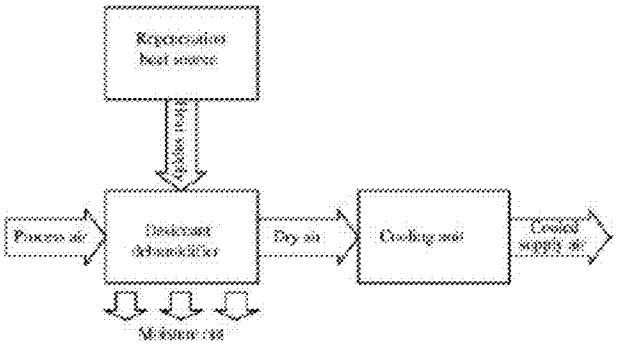
FIG. 3 is a schematic diagram illustrating the structure and operation of desiccant wheel used for de-humidification, according to an embodiment of the present invention.

Turning now to FIG. 2, additional details regarding the specific components of IAMU 10 are now provided. FIG. 2 is a functional block diagram of the components and does not necessarily represent actual component placement or the correct scale. With reference to FIG. 3 also, the primary air treatment components along their position with respect to airflow is provided. IAMU 10 preferably includes an intake area where at least one temperature/relative humidity sensor 250 is present for measuring and reporting ambient conditions with respect to intake air. Fan 240 may be operated at variable speeds or turned off under the control of control unit 170 in order to control the velocity of air being processed by IAMU 10 at any one time. Outdoor air may be caused to bypass the treatment components of IAMU 10 (cooler, de-humidifier) by redirecting air through bypass duct 260. In some embodiments, air will always flow through fan 240 before reaching bypass duct 260 while in others, air will not even flow through fan 240 before entering bypass duct.

Assuming that air is not re-directed through bypass duct 260, it is treated by the various components of IAMU 10 as now described. In some embodiments, air passes through a de-humidifier which comprises desiccant wheel 230. Desiccant wheels are capable of absorbing a significant amount of moisture from the airstream. These wheels typically include a cylindrical matrix that consists of a large number of honeycomb or corrugated flow channels. To make moisture transfer possible, desiccant wheel 230 has channels that are coated with micron-sized, highly porous desiccant particles which have a strong affinity for water vapor. Examples of such particles/structures include silica gels, molecular sieves, activated alumina and/or zeolites.

Figure 4:
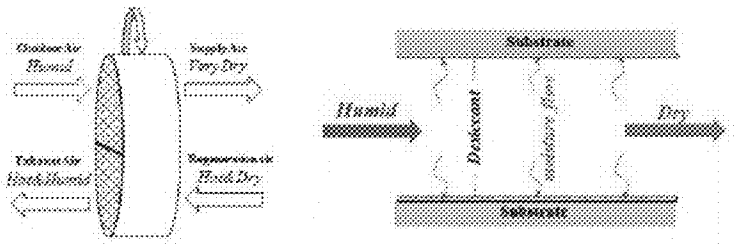
FIG. 4 is another diagram illustrating the operation of desiccant wheel, according to an embodiment of the present invention for implementing de-humidification.

A schematic diagram of desiccant wheel is shown in FIG. 4. Two air streams are required to operate desiccant wheel 230—humid air (outdoor air) and hot-dry air (regeneration). When the outdoor humid air passes through the wheel channels, water vapor is absorbed by the desiccant particles. As wheel 230 rotates and the channels are exposed to the hot-dry airstream, the accumulated moisture in the wheel matrix is released into the airstream. As a result of continuous rotation of wheel 230, moisture is transferred between the supply and exhaust airstreams periodically. In a preferred embodiment, in order to condition the regeneration air, an external heat source, such as gas or electric heat is required and is typically coupled with desiccant wheel 230.

Returning now to FIG. 2, it can be seen that once the airflow is de-humidified via desiccant wheel 230 it may then pass to cooling unit 270. In one embodiment, cooling unit is comprised of a series of tubes with coolant gas or liquid being circulated therein. Cooling coils are widely available and may be selected based on the specific cooling load required.

As can be seen in FIG. 2, an external heat source may be provided comprising fan 210 and heater 220 which collectively provide the regenerated heated air described as necessary to operate desiccant wheel 230. In addition, or alternatively, heat may be sourced from the outside of the cooling coils associated with cooling unit 270. Intake air supplied through fan 210 may be sourced from either or both of outdoor air or the supply air as shown in FIG. 2.

When using existing drying techniques, an aeration fan will not be able to dry grain if the outside air has a higher relative humidity than the grain and it will not be able to cool the grain if the outside air is warmer than the grain. In most geographic locations, this is the case most of the time, especially during the day. According to the teachings of the present invention, both the relative humidity of the air and/or the temperature of the intake air may be reduced resulting in an ability to use the system of the present invention most of the time. In some embodiments, the system may be shut down to save energy and/or prevent damage to the grain when it is currently raining and/or when the relative humidity in the air is otherwise very high. In the case where the outside air temperature and/or relative humidity is higher than that of the grain, water vapor molecules in the air may be cooled down below the dew points and, as a result, this moisture may condense on the grain surface. The condensed water molecules adversely increase the grain moisture content.

However, with the present system, the drying process is faster and more effective for at least two reasons. First, by reducing the air flow relative humidity, the driving force for moisture transfer increases and, as a result, the drying process takes place faster and more efficiently. In addition, the system of the present invention includes a novel feedback control strategy as follows:

1) Identifies the critical conditions, above which the moisture transfers from the air flow to the grain;
2) When this critical condition is reached, the system may be shut down or operating conditions modified (including bypass of the dehumidifier and/or cooling unit) so as to prevent the introduction of additional moisture to the grain as well as to prevent the waste of energy; and
3) The system is capable of being controlled such that the dehumidification system can be turned on and off and/or adjusted in terms of operating speed so as to prevent grain suffering from additional moisture uptake as well as reducing the overall dehumidification load for the system.
4) The system also employs internal temperature and relative humidity measurements within the grain to check for desired grain moisture content. The system can be configured to shut off automatically and/or sent an alert to a user to manually stop or adjust the operation of the system. This allows for efficient energy usage so that the system does not remain in operation once the desired drying/cooling effects have been achieved.
5) The system may also employ one or more sensors at one or more air exits from the grain bin. This provides additional data regarding the effectiveness of the system operation so that operational function can be controlled accordingly.

Figure 5:
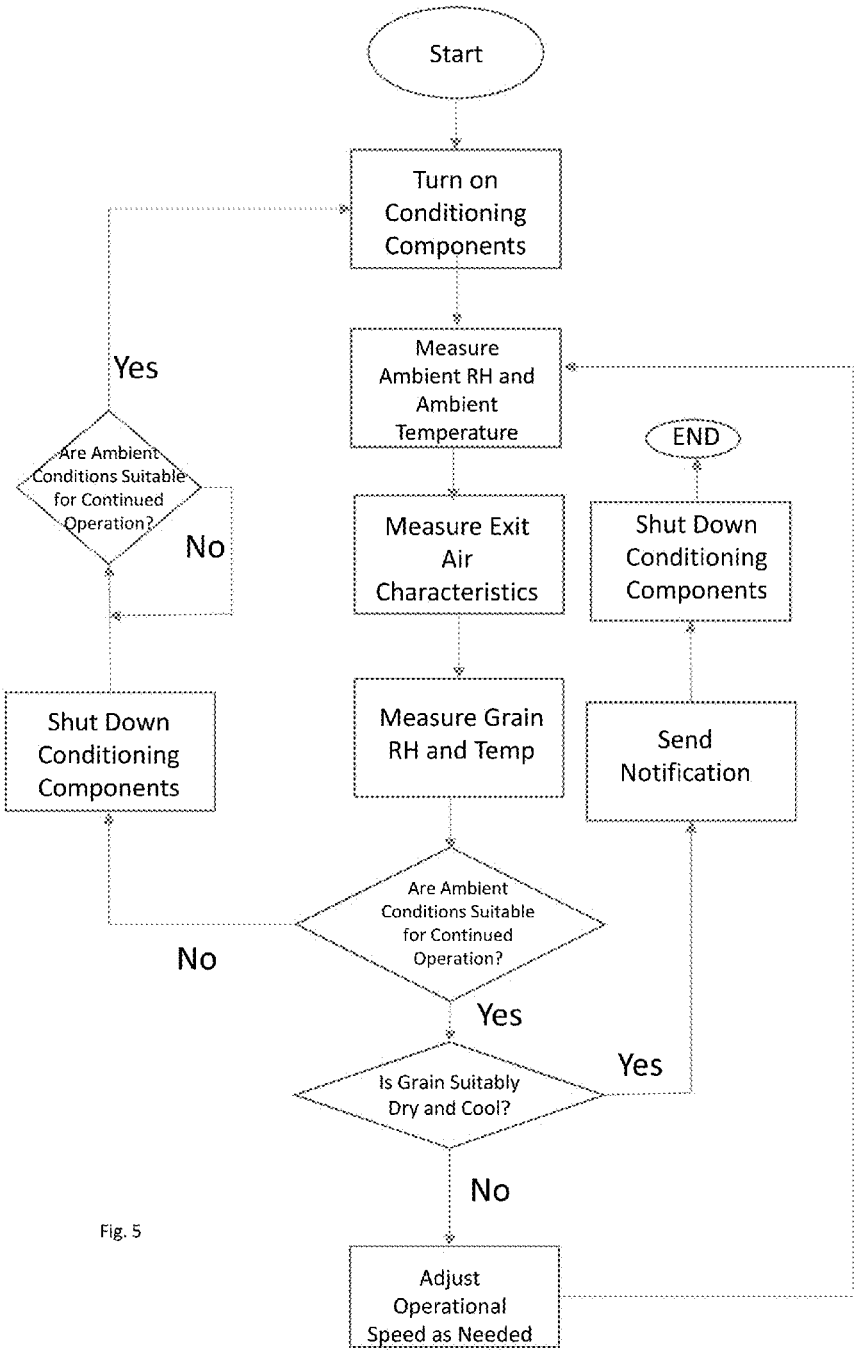
FIG. 5 is a flowchart illustrating the methodology for conditioning grain contained in a grain bin, according to one embodiment of the present invention.

With reference now to FIG. 5, a discussion of the process flow for grain conditioning according to the teachings of the present invention, in a preferred embodiment thereof, is now present. The process begins by turning on the conditioning components. This may be one, two or all of fan 155, dehumidifier 190 and/or cooling unit 180. In some embodiments, initial operation of these components may be at a relatively low level (speed). Speed/operating level of these conditioning components may then be increased (or decreased) as determined by the system using sensor feedback as more particularly described below. All operations described are typically under the control of control unit 170 which receives data from sensors and also controls the speed and operating state of the conditioning components.

Next, ambient relative humidity and ambient temperature are measured under the control of control unit 170. This may be done at sensor(s) 165 at the intake to the system or by other sensors which are preferably in close proximity to grain bin 100. In addition, a complete weather station with additional sensors may be employed to measure and capture other atmospheric data such as whether it is currently raining and/or amount of rainfall in a predetermined historic period.

At the next step, system 10 measures the exit air characteristics at one or more apertures where air may escape from grain bin 100. This may include air temperature, relative humidity as well as other characteristics. This data as well as the ambient air conditions measured at the previous step are made available to control unit 170 to permit system control as discussed below.

At the next step, one or more sensors which are embedded within the grain itself are used to measure grain characteristics at various locations within the grain. These characteristics may include the moisture content of the grain and the temperature of the grain at various locations within the grain contained within grain bin 100. It will be noted by one of skill in the art that the order of measurement of all of the foregoing characteristics need not take place in the particular order described above—the measurements can occur simultaneously, near simultaneously or in any other order while still remaining within the scope and spirit of the present invention.

Next, based on the collective data obtained as described above, system 10, under the control of control unit 170 makes a determination as to whether the conditions are suitable for cooling and/or drying operations. For example, if it is raining and/or the ambient relative humidity is otherwise very high, control unit 170 may determine that more harm than good can be done if any or all of the conditioning components remained in operation so some or all of them may be shut down in these cases (the "no" branch from the "Are Ambient Conditions Suitable for Continued Operation" decision block). In the event that this branch is followed, the conditioning components are shut down and then ambient conditions are continuously/periodically monitored in order to wait for a time when ambient conditions do become suitable for grain conditioning using system 10 at which time the conditioning components are restarted and sensor measurements taken again as described above.

Alternatively, if the "yes" branch from the Are Ambient Conditions Suitable for Continued Operation" decision block is taken, then the in-grain sensors 110 and/or the exit air sensors 130 provide data to assess if the grain is currently suitably cool and dry. If yes, then system 10 may send out one or more notifications of that status to one or more user devices and the conditioning components may be shut down since no further conditioning is required. Alternatively, if the "no" branch is taken (meaning that the cooling and drying are not complete), then the process continues by adjusting the speed/operational level of the conditioning components based on the collective sensor input. In this regard, example data and resulting operational changes as necessitated by this step are provided below. After the changes are made, the process loops back to take additional sensor measurements and the overall process repeats until the grain is determined to be suitably dry and cool.

As just noted, some exemplary data is now provided with respect to potential driven operational characteristics of conditioning components based on exemplary sensor data. One of skill in the art will recognize that this data represents only some of the potentially unlimited scenarios and that the invention is not necessarily limited to these examples nor should the data be taken as that which is necessarily implemented since internal and external factors and operational characteristics will vary at each and every installation of system 10.

Example #1

Ambient Temp=15° C.
Ambient RH=63%

Exit Temp=17° C.
Exit RH=46%
Grain Bin Level=90%
Average Grain Temp=20° C.
Rain=No In this case, control unit 170 might direct the following settings for system operation:
Fan speed=100% of full speed
Cooling unit=100% of full cooling capacity
Desiccant wheel spinning at 100% of full speed
0% of air being diverted through bypass duct.

By way of example, the exit relative humidity in this case might be high at the beginning (e.g. 46%) and drop fast at first and then slowly and finally reach a value approximating 15%. This is reflective of what might happen at harvest time in the prairies in Canada.

Example #2

Ambient Temp=15° C.
Ambient RH=11%
Exit Temp=17° C.
Exit RH=30%
Grain Bin Level=90%
Average Grain Temp=20° C.
Average Grain Moisture=16%
Rain=No In this case, control unit 170 might direct the following settings for system operation:
Fan speed=100% of full speed
Cooling unit=100% of full cooling capacity
Desiccant wheel spinning at 50% of full speed
0% of air being diverted through bypass duct.

The exit relative humidity will be likely be high at the beginning (30%) and drop fast at first and then slowly (and reach e.g. 5%). The goal is to bring down the grain moisture level to 12% (hypothetical). Depending on the grain type that could mean that the system should be shut down when the exit relative humidity reaches approximately 15%. At this point a second goal might be to cool the grain down to 15° C. which means that control unit 170 would decrease the desiccant wheel's speed (so that the grain is not over dried) and continue cooling the grain. This is another example of what might happen at harvest time in the prairies in Canada.

Example #3

Ambient Temp=15° C.
Ambient RH=40%
Exit Temp=5° C.
Exit RH=30%
Grain Bin Level=85%
Average Grain Temp=−6° C.
Average Grain Moisture=13%
Rain=yes This might drive the following settings for the conditioning components:
Fan speed=100% of full speed
Cooling unit=0% of full cooling capacity
Desiccant wheel spinning at 100% of full speed
0% of air being diverted through bypass duct.

When it rains, the ambient relative humidity is low at the beginning and as it rains more, it increases. Depending on how long it rains and the temperature, the final relative humidity can vary. If the relative humidity reaches a point where the system is unable to take enough of the moisture out of the air, the system will be shut down to prevent damaging the grain. Here the goal might be to bring down the moisture level to a value approximating 11%. This could mean that the system continues to run until the exit relative humidity reaches approximately 20%. This is an example of what might happen in late spring in the prairies in Canada. might happen at harvest time in the prairies in Canada.

Example #4

Ambient Temp=15° C.
Ambient RH=3%
Exit Temp=5° C.
Grain Bin Level=85%
Average Grain Temp=−6° C.
Average Grain Moisture=13%
Rain=no This might drive the following operational levels:
Fan speed=100% of full speed
Cooling unit=0% of full cooling capacity
Desiccant wheel spinning at 0% of full speed
100% of air being diverted through bypass duct.

In this case, the air is dry enough to dry the grain and bring the moisture level to 11%. This is an example of what might happen at late spring in the prairies in Canada.

According to the teachings of the present invention, various advantages are derived in connection with the conditioning of grain within a grain bin through the use of the novel system and methodologies as described above.

The present invention is not limited to the particular embodiments illustrated in the drawings and described above in detail. Those skilled in the art will recognize that other arrangements could be devised. The present invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application While the present invention has been described with reference to specific illustrative embodiments, modifications and variations of the present invention may be constructed without departing from the spirit and scope of the present invention as set forth in the following claims.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. A grain conditioning system configured to condition grain stored, at rest and while in a grain storage bin, comprising:
- a control unit;
- at least one intake air fan located at an intake port and under a control of said control unit;
- at least one air intake sensor located at said intake port and configured for communication with said control unit;
- a dehumidifier under the control of said control unit;
- a cooling unit under the control of said control unit;
- at least one exit sensor located at an opening in said grain storage bin and configured for communication with said control unit;

wherein said control unit controls operational characteristics of said intake air fan, said dehumidifier and said cooling unit in response to data received from each of said at least one air intake sensor and said at least one exit sensor, said operational characteristics comprise an operating capacity of said at least one intake air fan controlling an amount of an air flow to be directed into said grain storage bin and toward said grain stored, at rest and while in said grain storage bin, an operating capacity of said dehumidifier controlling a dehumidification level of said air flow so as to dry said grain stored in said grain storage bin, and an operating capacity of said cooling unit controlling an amount of cooling of said air flow, and said at least one intake air sensor being disposed at a beginning of said air flow, and said at least one exit sensor being disposed at an end of said air flow and sensing said air flow subsequent to travel of said air flow through said grain stored, at rest and while in said grain storage bin.

2. The system of claim 1 further including at least one sensor cable located in said grain storage bin.

3. The system of claim 2 wherein said at least one sensor cable comprises a plurality of grain sensors disposed at a plurality of locations within grain contained in said grain storage bin.

4. The system of claim 3 wherein said control unit employs data from said grain sensors in controlling the operational characteristics of said intake air fan, said dehumidifier and said cooling unit.

5. The system of claim 1 further including a bypass control under the control of said control unit for controlling an amount of said air flow passing over each of said dehumidifier and said cooling unit.

6. The system of claim 1 further comprising at least one reader configured for communication with said control unit, wherein said reader is further configured to communicate wirelessly with a gateway.

7. The system of claim 6 further comprising at least one user device configured to communicate with said gateway and, in turn, with said control unit for controlling said operational characteristics of each of said bypass control, said dehumidifier, said cooling unit and said air intake fan.

8. The system of claim 1 further comprising at least one user device configured to communicate directly with said control unit for controlling said operational characteristics of each of said bypass control, dehumidifier, said cooling unit and said air intake fan.

9. The system of claim 1 further comprising at least one rain sensor configured for communication with said control unit and for detecting the presence of rain.

10. The system of claim 9 wherein said control unit further employs data from said at least one rain sensor in controlling the operational characteristics of said intake air fan, said dehumidifier and said cooling unit.

11. The system of claim 1 wherein said operating capacity of said cooling unit comprises a fan speed of said cooling unit.

12. The system of claim 1 wherein said operating capacity of said cooling unit comprises a power level of said cooling unit.

13. The system of claim 1 wherein said operating capacity of said dehumidifier comprises a power level of said dehumidifier.

14. The system of claim 5 wherein said operational characteristics comprise a control of said bypass control to dictate the amount of air passing over said cooling unit and said humidifier as opposed to the amount of air bypassing said cooling unit and said humidifier.

15. A method for conditioning grain stored, at rest and while in a grain storage bin, comprising:

receiving data from at least one air intake sensor located at an intake port;

receiving data from at least one exit sensor located at an opening in said grain storage bin; and conditioning an air flow to be directed into said grain storage bin and toward said grain stored, at rest and while in said grain storage bin, by controlling operation of an air intake fan configured to source said air flow, a dehumidifier configured to dehumidify said air flow, and a cooling unit configured to cool said air flow, in response to data being received from each of said at least one air intake sensor and said at least one exit sensor such that said air flow is conditioned and delivered into said grain storage bin subsequent to being cooled and dehumidified, in response to an analysis of said data received from each of said at least one air intake sensor and said at least one exit sensor, wherein said at least one intake air sensor is disposed at a beginning of said air flow, and said at least one exit sensor is disposed at an end of said air flow in order to sense said air flow subsequent to travel of said air flow through said grain stored, at rest and while in said grain storage bin.

16. The method of claim 15 further including controlling a bypass control unit for controlling an amount of said air flow passing over each of said dehumidifier and said cooling unit.

17. The method of claim 16 wherein at least one user device is provided to communicate with a gateway which is configured for communication with a control unit for controlling operational characteristics of each of said bypass control, said dehumidifier, said cooling unit and said air intake fan.

18. The method of claim 16 wherein at least one user device is provided to communicate directly with a control unit for controlling operational characteristics of each of said bypass control, said dehumidifier, said cooling unit and said air intake fan.

19. The method of claim 15 further including receiving data from at least one rain sensor configured to detect the presence of rain and employing data received from said at least one rain sensor for controlling operational characteristics of each of said bypass control, said dehumidifier, said cooling unit and said air intake fan.

20. The method of claim 17 wherein said at least one user device communicates with said gateway through a cloud computing architecture.

* * * * *